US005348298A

United States Patent [19]

Montgomery

[11] Patent Number: 5,348,298

[45] Date of Patent: Sep. 20, 1994

[54] COMBINATION ROLLER BALL AND HOCKEY PUCK

[76] Inventor: Robert D. Montgomery, 1685 W. 12th St., Reno, Nev. 89503

[21] Appl. No.: 161,885

[22] Filed: Dec. 3, 1993

[51] Int. Cl.[5] ..... A63B 71/00

[52] U.S. Cl. ..... 273/128 R

[58] Field of Search ..... 273/57.2, 128 R

[56] References Cited

U.S. PATENT DOCUMENTS

| | | | |
|---|---|---|---|
| 2,467,043 | 4/1949 | Kotler | 372/128 R |
| 2,494,929 | 1/1950 | Colaluca | 273/128 R |
| 2,511,147 | 6/1950 | Braun | 273/128 R X |
| 2,998,251 | 8/1961 | McShane | 273/128 R |
| 3,310,307 | 3/1967 | Brown | 273/128 R X |
| 3,954,267 | 5/1976 | Freeman et al. | 273/128 R X |

FOREIGN PATENT DOCUMENTS

| | | | |
|---|---|---|---|
| 1092539 | 11/1954 | France | 273/128 R |
| 1710085 | 2/1992 | U.S.S.R. | 273/128 R |

*Primary Examiner*—Paul E. Shapiro

[57] ABSTRACT

A combination roller ball and hockey puck which includes the following; a cylindrical hollow housing having an interior chamber, an arcuate shaped bottom, a circumfused sidewall and a top. The puck provides means for introducing a powder substance within the chamber and weep holes from the sidewall and bottom evenly disperse the powder onto a playing surface. A replacable rubber band surrounds the sidewall for inhanced rebound and a weight within the housing minimizes accidrental turn-over.

5 Claims, 1 Drawing Sheet

COMBINATION ROLLER BALL AND HOCKEY PUCK

CROSS REFERENCE TO RELATED APPLICATION

The present invention relates to U.S. Ser. No. 08/096,438, filed on Jul. 26, 1993 by the same inventor and is incorporated herein by reference.

FIELD OF THE INVENTION

This invention relates, in general, to hockey pucks but more particularly to a puck which can be used as a roller ball and/or hockey puck in combination.

BACKGROUND OF THE INVENTION

In the past, a number of different types of pucks have been devised, some of which teach a puck designed for a specific purpose, such as the following: U.S. Pat. No. 5,207,720 provides a practice puck used to determine, in relative terms, the energy of impact when the puck is driven into a solid object. U.S. Pat. No. 5,249,797 is a "Hockey Training Apparatus", which includes a puck designed specifically for use with the apparatus disclosed therein. The puck must include magnetic material so as to provide signal means for electronic sensors, also, the puck includes a plurality of vertical weep holes located on the bottom of the puck which are used for dispersing a lubricant powder retained therein.

Some patents are specifically designed to facilitate movement upon a playing surface, such as U.S. Pat. Nos. 5,184,820, 4,801,144 and 4,793,769, each of which include bearings, balls or projections which tend to roll the puck on the playing surface.

Further patents are produced from unconventional materials such as the following: U.S. Pat. No. 4,878,668 which discloses an indoor hockey puck having a felt-like layer between two leather-like end discs connected by stitching. U.S. Pat. No. 4,754,973 provides a puck formed from a continuous band containing two separate materials arranged in layers. U.S. Pat. No. 3,704,891 teaches a puck incorporating into the main body a material having a specific gravity to provide the puck with increased weight, greater than 5.5 to 6.0 ounces. U.S. Pat. No. 3,675,928 discloses an "Impact Safety Hockey Puck" which includes a collapsible sidewall and a central body portion produced from polyethylene or the like, and a cavity defining wall produced from a plastic material softer than the material of the central body. U.S. Pat. No. 4,153,253 provides a main body portion produced from firm foam rubber while two end plates are produced from thermoplastic material.

Unlike the prior art of mention, the present invention can be used for a roller ball as well as a hockey puck due to a unique, arcuate shaped bottom. The bottom includes a weight which when positioned on a flat surface, allows the puck to pivot or become airborne. Also, provided is a replaceable rubber band which surrounds the main body and enhances rebound. The main body includes a filler hole and a hollow cavity which captures a powder substance there within. The powder is dispersed through multiple weep holes when the puck collides with an object and the powder is not only dispersed from the arcuate shaped bottom but from the side walls as well, this tends to eliminate caking of the powder which is an inherent problem with prior art such as U.S. Pat. No. 5,249,797.

SUMMARY OF THE INVENTION

It is therefore a primary object of the present invention to provide a combination puck which can be used for roller ball and/or hockey.

A further object is to provide a puck with an arcuate shaped bottom.

A very important object is to provide the puck with a weight which when the puck rests on a level surface, allows the puck to pivot or become airborne.

Still another object is to provide the puck with a filler hole and a hollow cavity which accepts and captures a powder material there within.

Yet another object is to provide the puck with weep holes for dispersing a powder not only from the bottom but from the side walls as well.

Another object is to provide the puck with a replaceable rubber band which surrounds the puck and enhances rebound.

Yet another object is to provide a puck which can be made simply from either rubber, plastic, or the like, by injection molding.

Further objects and advantages will become apparent when taken into consideration with the following drawings and specifications.

DETAILED DESCRIPTION OF THE DRAWINGS

Figure 1:
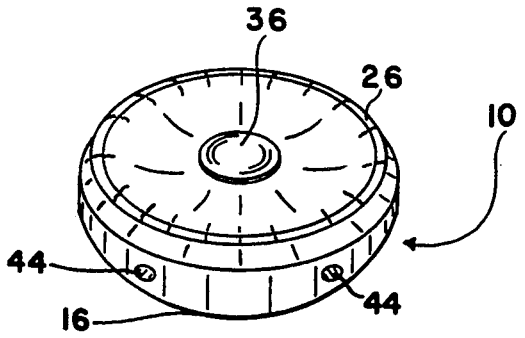
FIG. 1, is a perspective view showing a puck.
Figure 2:
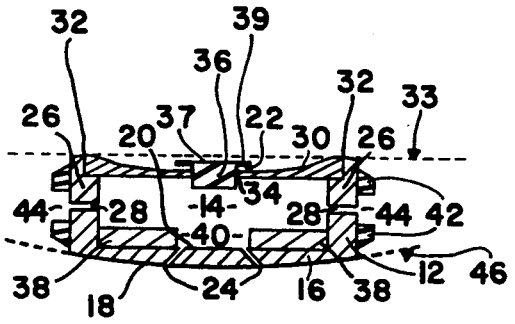
FIG. 2, is a sectional view taken at 2—2 of FIG. 3 which shows the angle of the arcuate shaped bottom.
Figure 3:
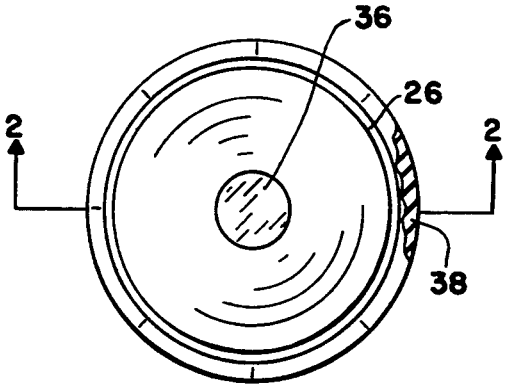
FIG. 3, is a top view showing a fill hole.
Figure 4:
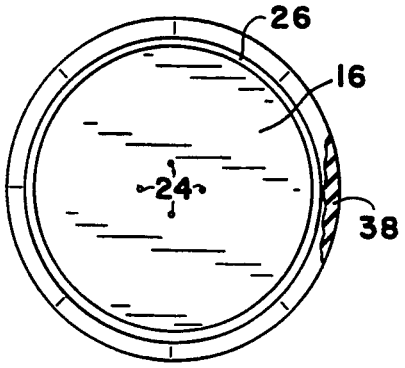
FIG. 4, is a bottom view showing weep holes.

Referring now in detail to the drawings, wherein like characters refer to like elements throughout the various drawings, the combination roller ball and puck, generally indicated by reference numeral 10, (as shown in FIG. 2), comprises a hollow cylindrical housing 12 which forms an interior chamber 14, a bottom 16 which has an arcuate shaped exterior surface 18, a flat shaped interior surface 20, multiple diagonal weep holes 24 and a circumfused sidewall 26. Sidewall 26 includes multiple horizontal weep holes 28 and provides means to attach a top member 30 by means such as threads, glue or a friction fit as shown in the preferred embodiment. At the junction of member 30 and sidewall 26, an arcuate outer rim 32 is formed to allow the puck 12 to still be functional when temporarily in an up-side-down position. Top member 30 includes means to fill interior chamber 14 with a substance such as powder (not shown) through filling hole 34. 34 is of a shape and size to accept a plug 36. Plug 36 is made from a resilient material such as rubber and has a sufficient depth to mate with hole 34 and has an outer exposed surface which when inserted within filler hole 34 is spaced apart from a plane, (as shown by arrow 33) formed across the rim 32. Plug 36 may be formed substantially in the shape of an inverted top-hat with the brim 39 of the top-hat forming space 22 apart from member 30 to allow the insertion of an object such as a screwdriver or the like for easy removal of plug 36. Also provided is a weight 38 which is positioned substantially on the interior surface 20 within chamber 14 which minimizes accidental turn over of the puck and is of a shape and size to mate with the interior surface 20 which may be fixidly attached by means such as glue (not shown) or the like. Weight 38 includes a bore 40 centrally located which is of a shape and size to allow passage of powder into weep holes 24. 42 is a replaceable rubber band, used for enhanced rebound and when positioned longitudinally, surrounds sidewall 26 in a secure manner and includes weep holes 44 which align with weep holes 28.

In use, plug 36 is removed, a quantity of powder (not shown) is poured into the interior chamber 14, plug 36 is replaced and captures the powder within chamber 14. When the puck 12 collides with an object, or is forcibly hit, the powder is dispersed out of the interior chamber 14 through weep holes 24 and 28 onto a playing surface such as a hockey court (not shown). Due to the arcuatly shaped exterior surface 18 (as depicted by arrow 46) and the diagonal holes 24 which direct the powder out and away from the puck, the powder is evenly dispersed and this unique improvement eliminates caking and blockage which occurs in the prior art, wherein, they disclose the use of vertical holes, whereby, the present invention provides a puck with improved sliding abilities.

It will now be seen that we have provided a puck which can be used as a roller-ball and/or a hockey puck. The puck includes unique means for evenly dispersing of a powder like substance, its weight distribution discourages accidental turn-over, it has improved rebound due to a replaceable rubber band and can be manufactured from a variety of materials, such as rubber, plastic, or the like, by injection molding.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by letters patent is:

1. A combination roller ball and hockey puck comprising: a hollow cylindrical puck housing having an interior chamber, said puck housing having a bottom, said bottom having an arcuate shaped external surface and a flat shaped interior surface, said bottom having multiple diagonal weep holes, said housing having a circumfused sidewall, said side wall having a height, said sidewall having multiple weep holes, said side wall being substantially vertically opposed to said bottom, a top, said top having means to engage and form a junction with said side wall, said junction forming an arcuate outer rim, said top having a filler hole for introducing a quantity of powder into said chamber, a plug, said plug being of a size and shape to mate with said filler hole, said plug having an outer exposed surface, said exposed surface when in an inserted position within said filler hole being spaced apart from a plane formed across said outer rim, a weight, said weight being of a shape and size to mate with said flat shaped interior surface, means to attach said weight, said weight including a bore centrally located which is of a size to allow passage of said powder through said diagonal weep holes, a replaceable rubber band, said band having a height less than said height of said sidewall, said band being of a size to longitudinally surround and capture said sidewall in a secure manner and said band having multiple horizontal weep holes which align with said weep holes of said sidewall.

2. The combination puck of claim 1 in which said plug is formed in the shape of a inverted top-hat, said top-hat having a first non-inserted position and a second inserted position, said top-hat having a first and second end, said first end of said top-hat having a brim and when said top-hat assumes said second inserted position, said brim forms a space apart from said top, whereby:

said space is of a shape and size to allow insertion of a screwdriver for removal of said top-hat.

3. The combination puck of claim 1 in which said means to attach said weight, is by glue.

4. The combination puck of claim 1 in which said means to attach said weight, is by friction.

5. The combination puck of claim 1 in which said weight is a magnet.

* * * * *